US007690298B2

(12) United States Patent
Jardine et al.

(10) Patent No.: US 7,690,298 B2
(45) Date of Patent: Apr. 6, 2010

(54) WASTE COMPACTION UNIT

(75) Inventors: Mark Hamilton Jardine, Colchester (GB); Michael John Hawker, Ipswich (GB)

(73) Assignee: Spacemaker Bins Limited (GB)

( * ) Notice: Subject to any disclaimer, the term of this patent is extended or adjusted under 35 U.S.C. 154(b) by 128 days.

(21) Appl. No.: 11/578,503

(22) PCT Filed: Apr. 12, 2005

(86) PCT No.: PCT/GB2005/001410

§ 371 (c)(1),
(2), (4) Date: Jul. 27, 2007

(87) PCT Pub. No.: WO2005/100003

PCT Pub. Date: Oct. 27, 2005

(65) Prior Publication Data

US 2008/0282912 A1 Nov. 20, 2008

(30) Foreign Application Priority Data

Apr. 13, 2004 (GB) ..... 0408116.2

(51) Int. Cl.
*B30B 1/38* (2006.01)

(52) U.S. Cl. ..... 100/269.02; 100/211; 100/247; 100/345; 100/347

(58) Field of Classification Search ..... 100/51, 100/90, 91, 211, 226, 227, 228, 229 A, 245, 100/269.02, 269.04, 295, 246, 247, 345, 100/347; 220/908
See application file for complete search history.

(56) References Cited

U.S. PATENT DOCUMENTS

| | | | | | |
|---|---|---|---|---|---|
| 3,478,909 | A | * | 11/1969 | Charles | 414/492 |
| 3,736,863 | A | | 6/1973 | Brucker | |
| 3,835,769 | A | * | 9/1974 | Peterson | 100/227 |
| 3,885,467 | A | * | 5/1975 | Merkin | 100/229 A |
| 5,355,789 | A | * | 10/1994 | Suzuki et al. | 100/92 |

FOREIGN PATENT DOCUMENTS

| | | | |
|---|---|---|---|
| GB | 2387527 | | 10/2003 |
| JP | 2003133595 | | 6/1991 |
| JP | 2001079685 | | 3/2001 |
| JP | 2003261201 | A * | 9/2003 |
| JP | 20033246405 | | 9/2003 |

OTHER PUBLICATIONS

Search Report for GB 0408116.2, Aug. 3, 2004, European Patent Office.
International Search Report for PCT/GB2005/001410, Aug. 4, 2005, European Patent Office.

* cited by examiner

*Primary Examiner*—Jimmy T Nguyen
(74) *Attorney, Agent, or Firm*—Bourque and Associates, PA

(57) ABSTRACT

A unit for compacting waste prior to disposal provides a waste compaction unit for fitting into a housing comprising a lid and an interior for collecting waste. The compaction unit comprises a plunger comprising bellows housed in the lid; a pneumatic locking mechanism housed in the lid; and a pump connected to the plunger via the locking mechanism wherein the pump is arranged in operation to activate the locking mechanism prior to inflating the bellows to extend the plunger axially towards the interior of the housing such that any waste collected therein is compacted.

2 Claims, 16 Drawing Sheets

WASTE COMPACTION UNIT

TECHNICAL FIELD

This invention relates to a unit for compacting waste prior to disposal. The unit is particularly useful but not limited to use in a domestic environment, for example in the home or in hotels and catering establishments.

BACKGROUND INFORMATION

Disposal of domestic waste is becoming more difficult in today's society, as more and more waste is produced, and the capacity of existing landfill sites is rapidly exhausted. Present methods of disposal of domestic waste are extremely inefficient due to the fact that the waste generally takes up so much volume in comparison to its weight. In general domestic waste is transported by waste disposal vehicles which carry between 10% and 20% of their potential capacity by weight, the total capacity being limited by the volume of the waste material. Some waste compaction is carried out by these waste disposal vehicles. In general the waste is subjected to compression during the journey, although due to the fact that most materials exhibit 'shape memory', once the waste material is emptied from the vehicle some expansion takes place and the waste material returns towards its original shape and therefore volume. Therefore landfill sites are filled up more quickly by this large volume waste than is strictly necessary.

SUMMARY

Waste processing systems are known which crush or pulverise waste prior to disposal. However, such systems are generally large and cumbersome and use a large amount of power to achieve the desired result. Use of excessive energy is contrary to the objective of providing a more environmentally friendly waste disposal system.

Known waste compacting systems intended for use in the domestic environment such as that described in U.S. Pat. No. 3,736,863 suffer from a number of drawbacks. If waste is compressed inside a bin liner, then the liner will tend to snag and tear against the compression member. Furthermore, the compressing apparatus will tend tilt and to compress unevenly due to different type of waste being present in the apparatus. If there is no locking mechanism then the apparatus can be unsafe. If an electrical locking mechanism is used it can be prone to failure, and will not necessarily be fail-safe.

The present invention seeks to alleviate such problems.

According to the invention there is provided a waste compaction unit for fitting into a housing comprising a lid and an interior for collecting waste, the compaction unit comprising

- a plunger comprising bellows housed in said lid;
- a pneumatic locking mechanism housed in said lid; and
- a pump connected to the plunger via said locking mechanism wherein the pump is arranged in operation to activate the locking mechanism prior to inflating the bellows to extend the plunger axially towards the bin interior such that any waste collected therein is compacted.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
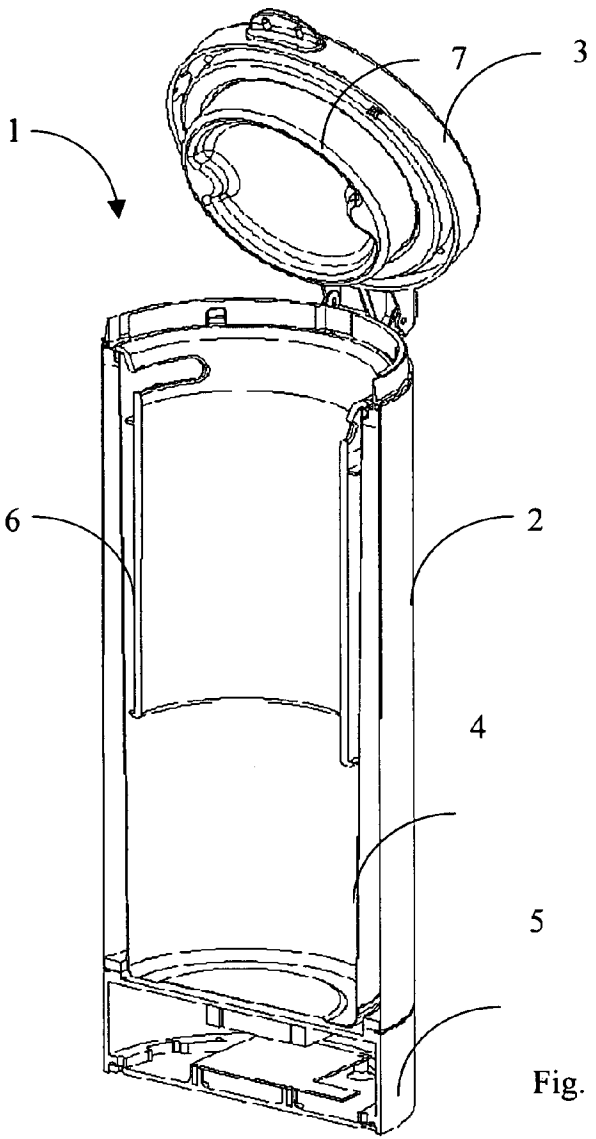
FIG. 1 illustrates a partially cut away three dimensional view of a waste compaction unit in accordance with the present invention.

FIG. 1 illustrates a partially cut away three dimensional view of a waste compaction unit 1 in accordance with the present invention. A conventional flip top bin assembly has a hinged lid 3, an outer bin 2 and an inner bin 4. The compaction unit 1 comprises a pump assembly 5, a compactor tube assembly 6 and a plunger assembly 7.

A pump housed in the pump assembly 5 is used to activate a plunger, which comprises bellows, housed in the plunger assembly 7. The plunger travels axially inside the compactor tube assembly 6 and compresses any waste in the unit.

Referring to FIGS. 2 to 5 the compactor tube assembly will now be described in more detail.

Figure 2:
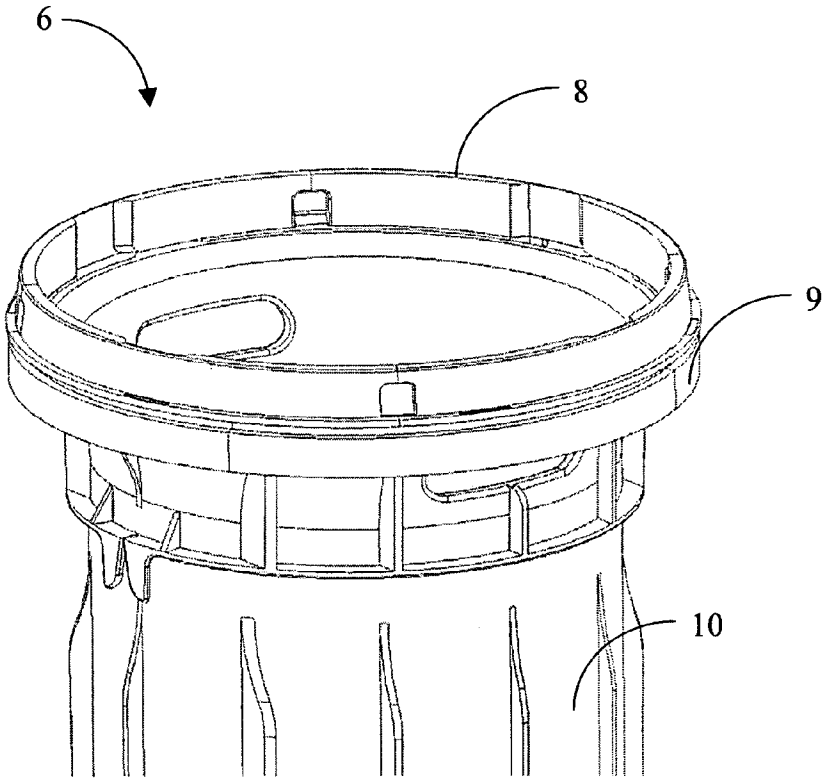
FIG. 2 illustrates part of a compactor tube assembly.
Figure 3:
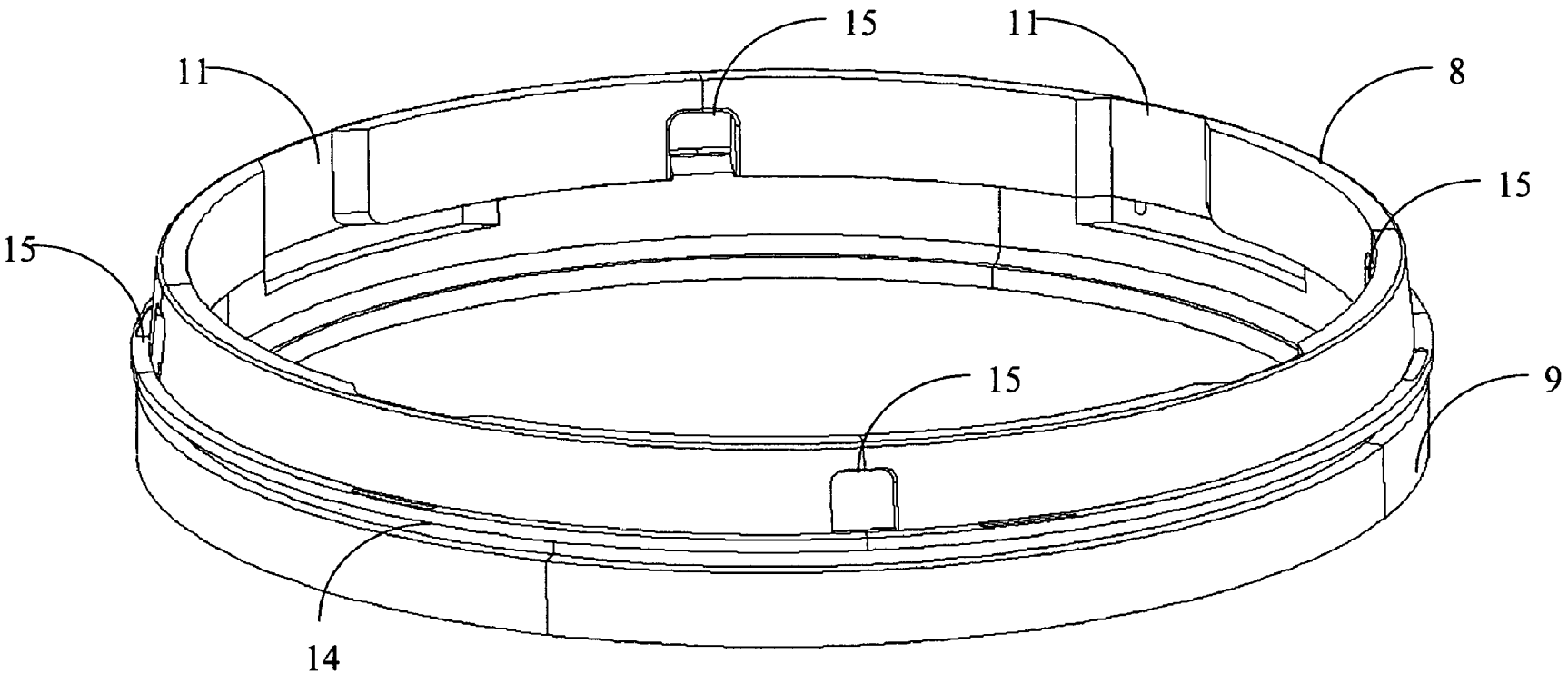
FIG. 3 illustrates a pair of locking rings.
Figure 4:
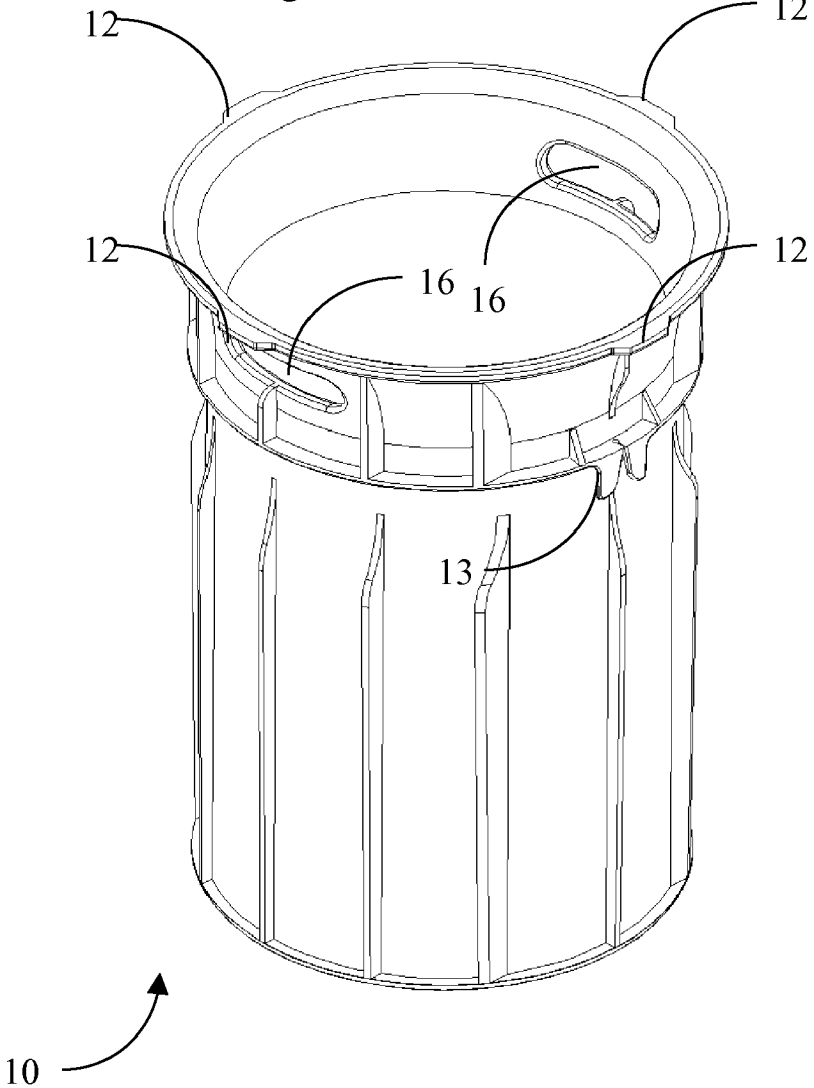
FIG. 4 illustrates a compactor tube.
Figure 6A:
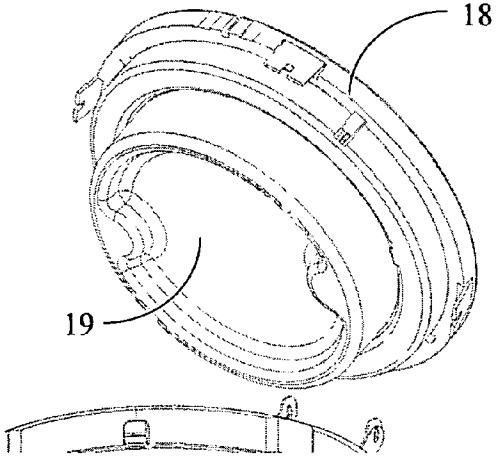
FIGS. 6*a* to 6*e* show various parts of a plunger assembly.
Figure 6B:
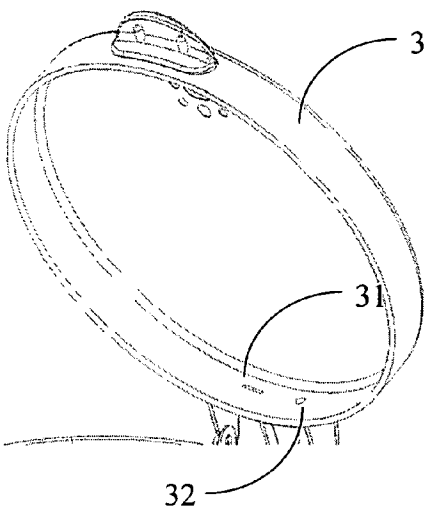
Figure 6C:
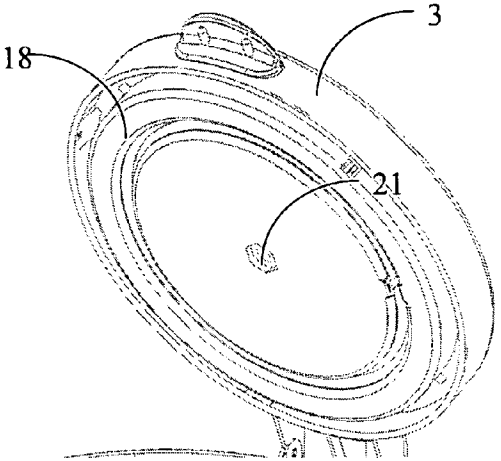
Figure 6D:
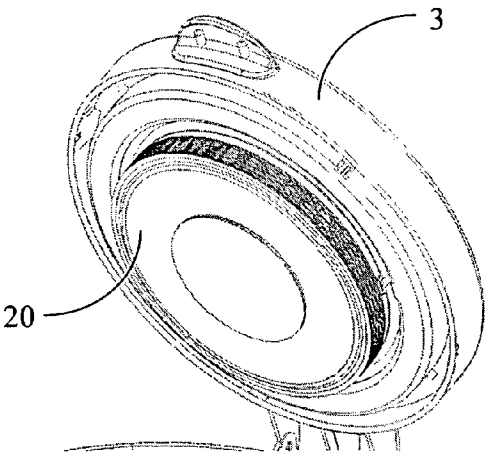
Figure 6E:
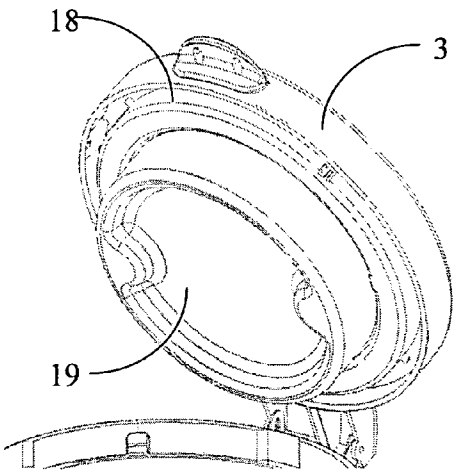

Referring firstly to FIG. 2, the compactor tube assembly comprises an upper locking ring 8, a lower locking ring 9 and a compactor tube 10. FIG. 3 illustrates the locking rings 9, 10 which are assembled to provide a bayonet fitting 11 for the compactor tube 10. FIG. 4 illustrates the compactor tube 10, which has tabs 12 to fit into corresponding bayonet fittings 11. The compactor tube 10 has bag locator tabs 13, of which only one is shown in FIG. 4, which are used for attaching conventional bin liner (not shown) to the outside of the compaction tube 10. Hand holds 16 are provided for ease of insertion and removal of the compaction tube 10 from the bayonet fittings 11 formed in the locking rings 8, 9. Ideally the compactor tube extends between one half and two thirds of the total bin height.

Figure 5:
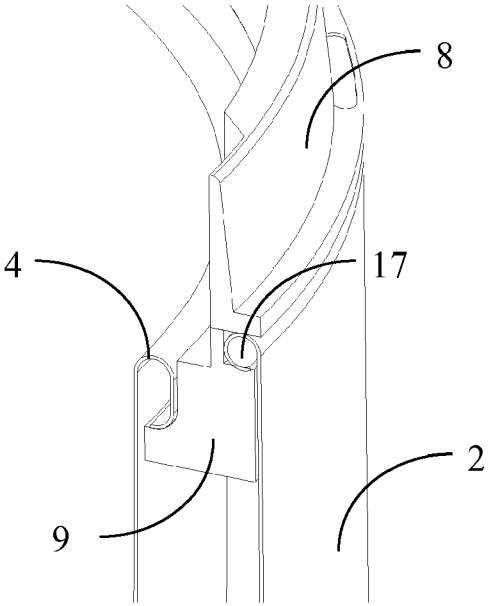
FIG. 5 illustrates a pair of locking rings attached to an outer bin.

Locking rings 8, 9 form a circumferential recess 14, which serves to attach the locking rings 8, 9 around an inner rim 17 of the outer bin 2 as illustrated in FIG. 5.

The locking rings are affixed to each other by conventional fixings; six bolts are inserted through the lower ring 9, and are screwed into the upper ring 8.

The compactor tube 10 helps to prevent tilting of the plunger and helps to prevent non uniform expansion caused by different types of waste having different compression characteristics. The compactor tube 10 also helps to prevent contact between the plunger and any bin liner, which is placed attached to the outside of the compactor tube, between the compactor tube and the inner bin. Conventional compactors with no compaction tube also have the problem that the bellows start deform and tilt axially as they expand. The gap between the compactor tube 10 is very small, in this embodiment of the invention it is 1 mm. The gap must be small to maintain the cylindricity, and prevent the plunger from tilting when compressing material of non-uniform density of the bellows.

Referring now to FIGS. 6 to 13 the plunger assembly 7 will be described in more detail.

FIGS. 6*a* to 6*e* show various parts of the plunger assembly comprising a lid moulding 18 and a plunger comprising a plunger casing 19 together with bellows 20.

Figure 7:
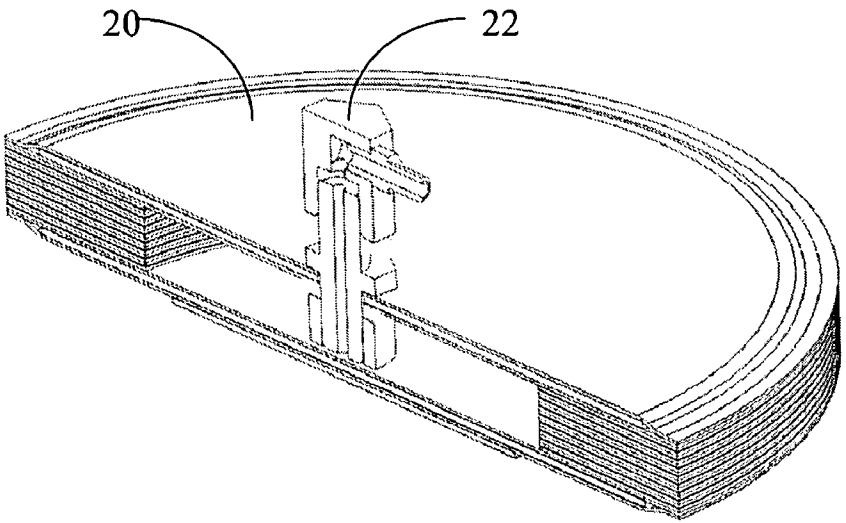
FIG. 7 illustrates deflated bellows.

FIG. 7 illustrates deflated bellows 20 showing connector 22 which is connected to the pump via an aperture 21 in the lid moulding 18. The plunger casing 19 is attachable to the bellows 20 by Velcro, or similar reattachable fixing to facilitate easy removal for cleaning. Furthermore, if a waste item gets trapped during decompression the plunger casing can disengage from bellows, allowing the bellows to retract fully into the lid and the locks 29 to disengage. The casing serves to protect the bellows 20 from damage. The casing in the embodiment described is cylindrical but protection could equally well be provided by a substantially flat plate. The depression in the centre of the plunger casing serves to push the waste material inwards and prevents it being pushed outwards towards the walls and locking the plunger.

The lid moulding houses a locking mechanism, and tubes for attaching the pump to the bellows 20.

The bellows 20 are substantially cylindrical when inflated and includes concertinaed side and a rigid plate at each end of the bellows. The rigid plates prevent bulging of the ends of the bellows during inflation.

Figure 8:
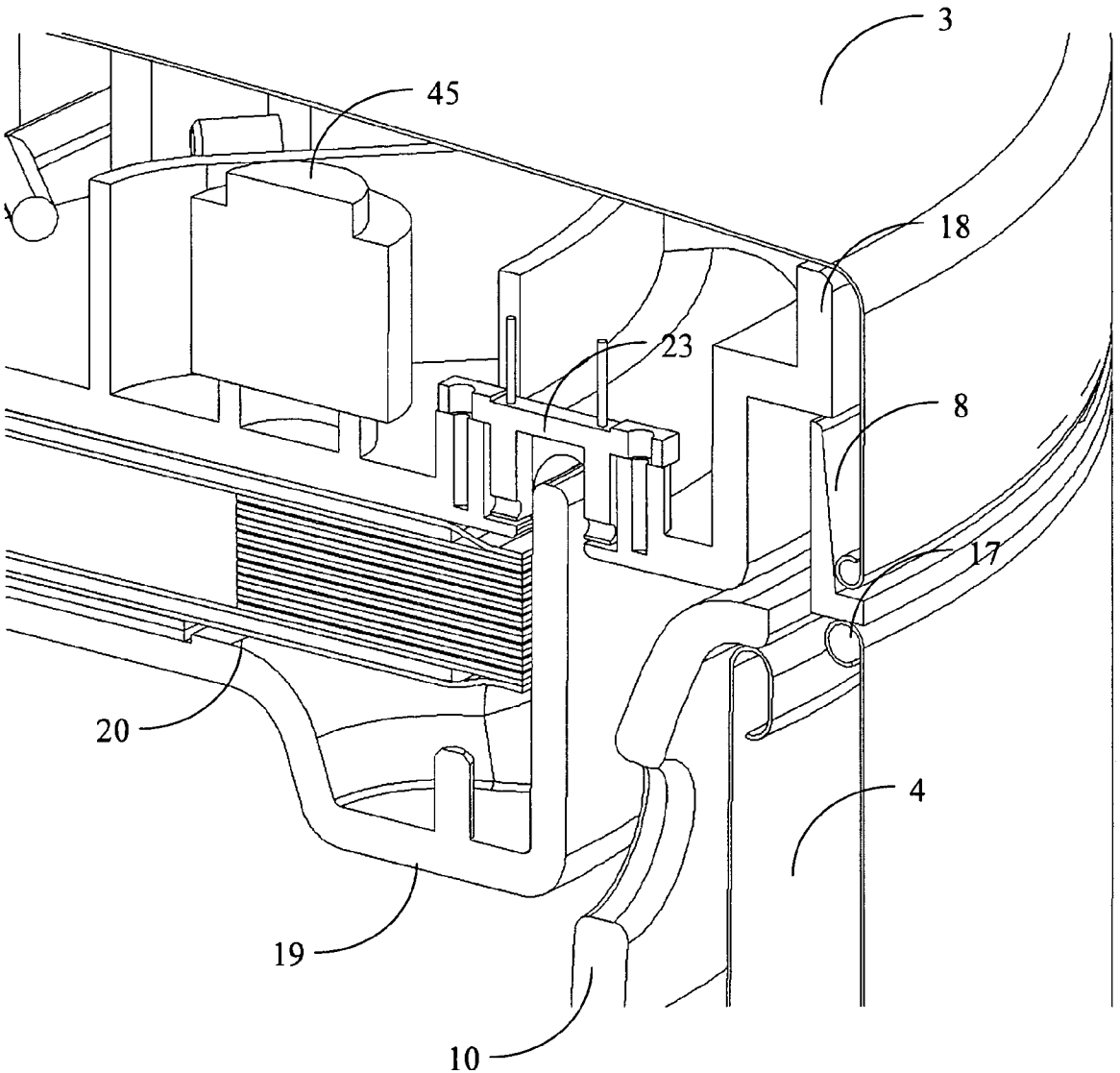
FIG. 8 is a close up partial cross section of part of a waste compaction unit.
Figure 9:
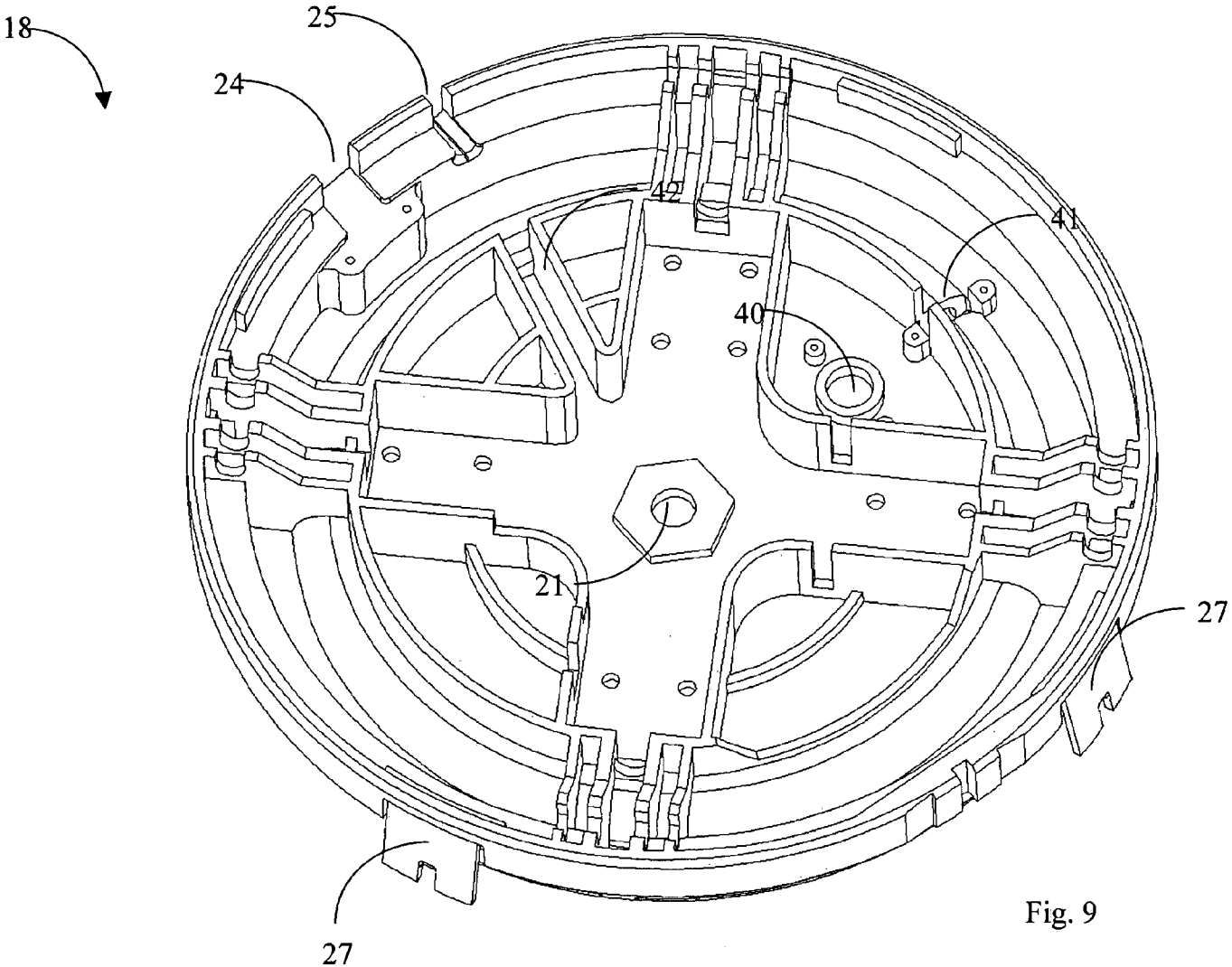
FIG. 9 illustrates a topside view of a lid moulding.

Referring now to FIG. 8, the lid moulding also houses a sensor 23. The sensor 23 uses an infra red beam to sense whether the plunger casing 19 is present. Any other suitable sensor may be used. The sensor 23 is connected to the pump, and pump will not operate to inflate the bellows 20 if the plunger casing 19 is not detected. If an attempt is made to activate without the plunger casing 19 the pump will not activate until the plunger casing 19 is replaced. This is to prevent damage to the bellows if the casing 19 has been removed, for example for cleaning in a dishwasher. An alarm 45, is provided, in this case a buzzer, which sounds when the pump is activated FIG. 9 illustrates a topside view of the lid moulding 18. Aperture 24 allows electrical connection to the sensor 23 and switch panel 33. Aperture 25 provides access for a tube connecting the pump to the bellows 20 via aperture 21. Fixings 40,41 are provided for the sensor 23 together with the alarm 45 The lid moulding 18 is attached to the lid 3 by snap fit locking tabs 27.

Figure 10:
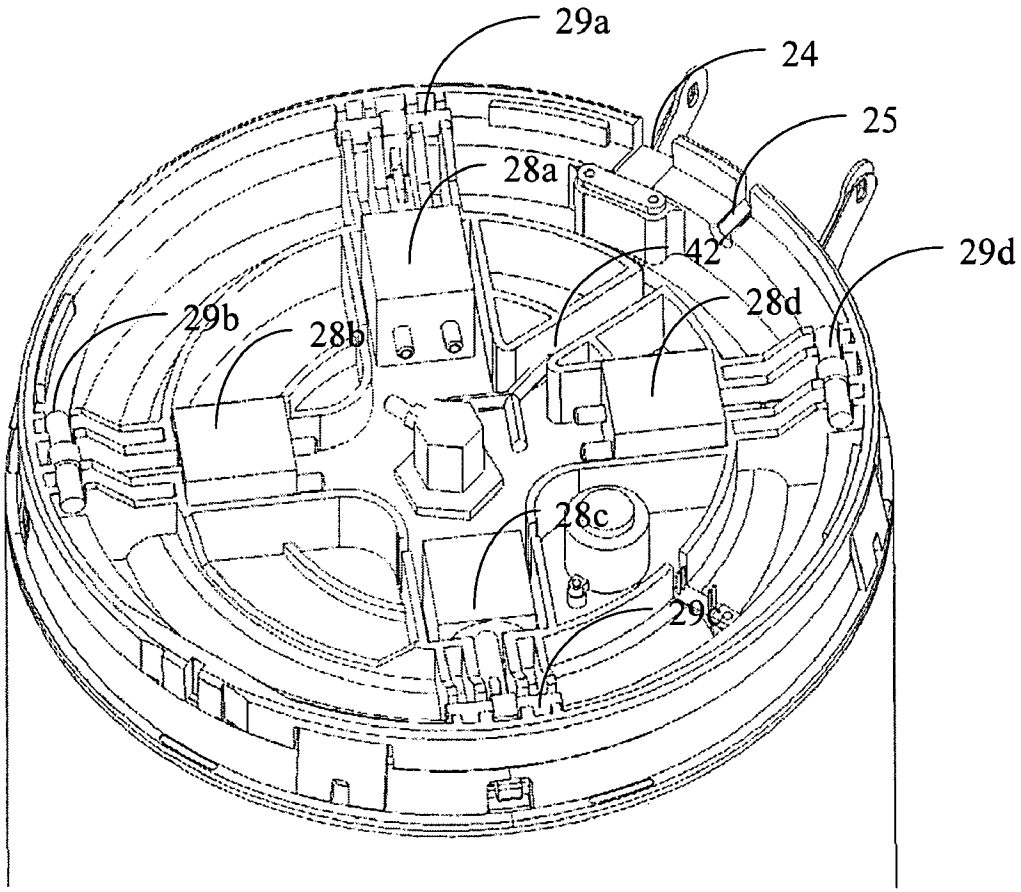
FIG. 10 illustrates locking pistons housed in the lid moulding of FIG. 9.

The lid moulding 18 houses a novel pneumatic locking mechanism, partially illustrated in FIG. 10. Four pistons 28*a*-28*d* are provided. The pistons 28 are connected to operate corresponding hooks 29*a*-29*d*. The pistons together with the hooks may be seen more clearly in FIG. 11*a*, which includes a partially cut away view of the upper locking ring 8. When the pistons are extended, hooks 29 engage apertures 15 in the locking ring to lock the lid 3 shut prior to inflation of the bellows.

Figure 11A:
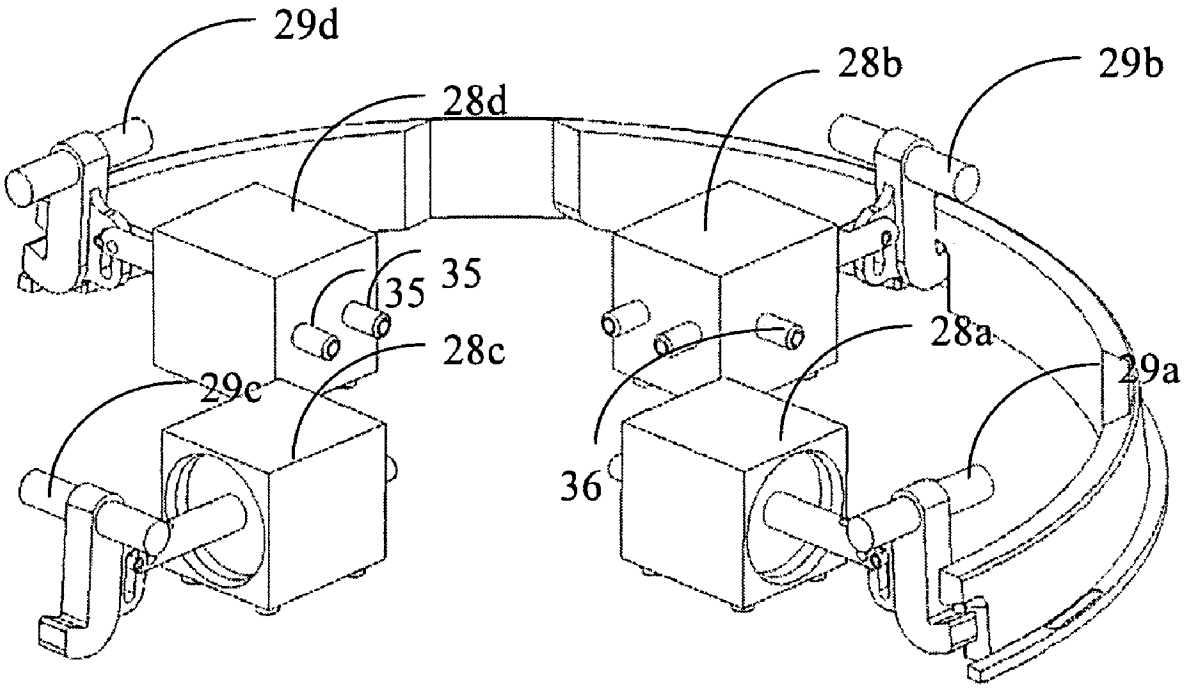
FIGS. 11*a* and 11*b* illustrates parts of a locking mechanism.
Figure 11B:
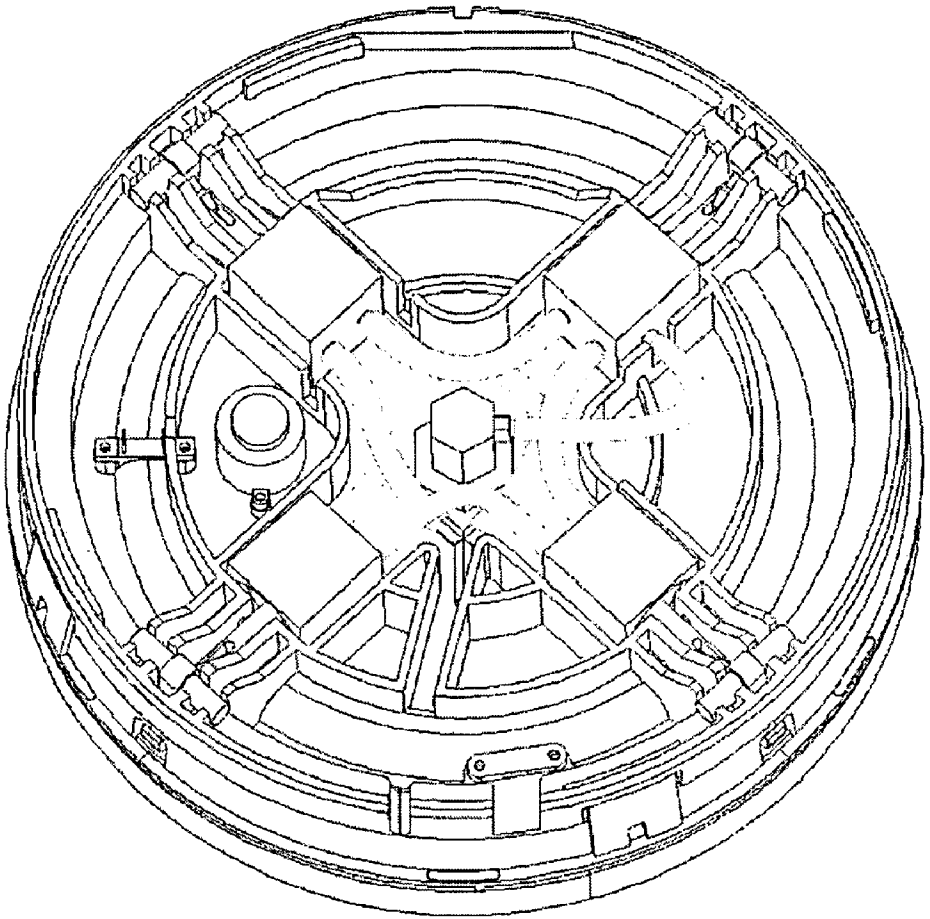

A tube from the pump enters through aperture 25 and along channel 42 in the lid moulding 18. The pump is connected to the pistons via ports 35, FIG. 11*a* at the rear of the pistons. The pistons may be connected to the pump, either in series or in parallel. One of the pistons 28*b* has a side port 32 which is then connected to a tube feeding the bellows 20. FIG. 11*b* illustrates the connected tubes in a preferred embodiment of the invention.

Figure 12B:
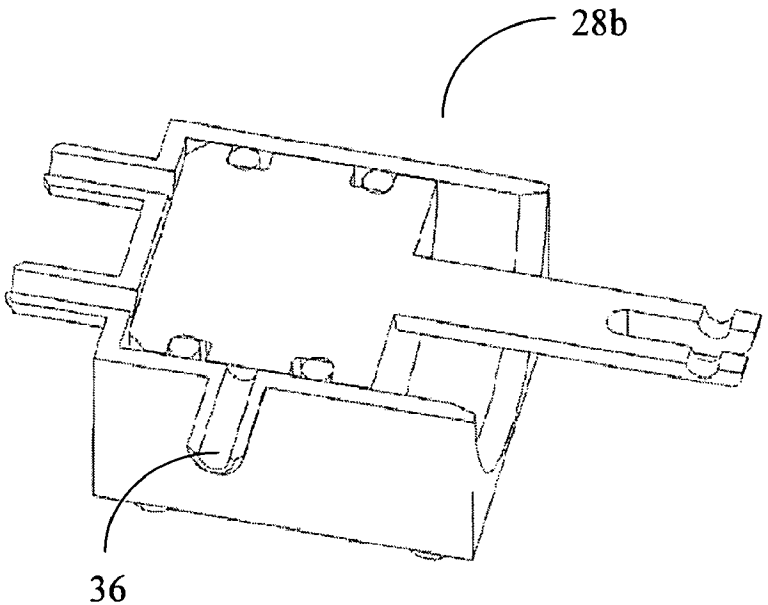
FIGS. 12*a* and 12*b* illustrate a piston detail.
Figure 12A:
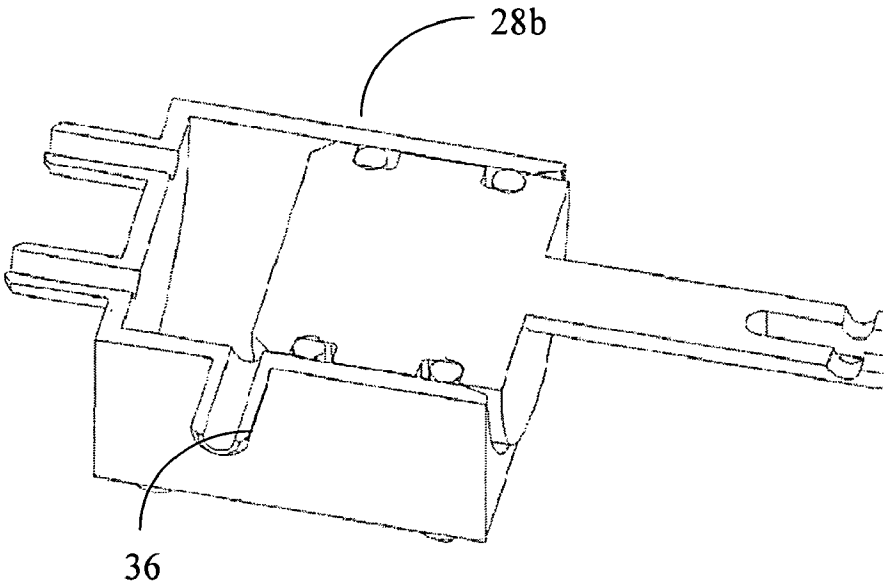

Detail of the piston 28*b* may be seen in FIGS. 12*a* and 12*b*, which show a cross section of the piston 28*b* in which the port 36 is in an open (FIG. 12*a*) and a closed (FIG. 12*b*) position.

Thus it can be seen that it is not possible for the bellows to start to inflate before piston 28*b* is extended such that the port 32 is open. In this extended position the hook 29*b* has engaged the aperture 15*a* to lock the lid 3 shut.

It is important that the friction characteristics of the pistons are such that the pistons 28*a*, 28*c*, 28*d* open before the piston 28*b*. This is achieved by providing a single "O" rings around pistons 28*a*, 28*c*, 28*d* and a double "o" rings around piston 28*b*. During deflation of the bellows, the bellows will deflate due to the fact the port 36 is open. Only when all the air has been evacuated from the bellows and the bellows has been fully retracted into the lid will there be sufficient vacuum in the system to retract all four pistons and all four locking hooks.

Figure 13A:
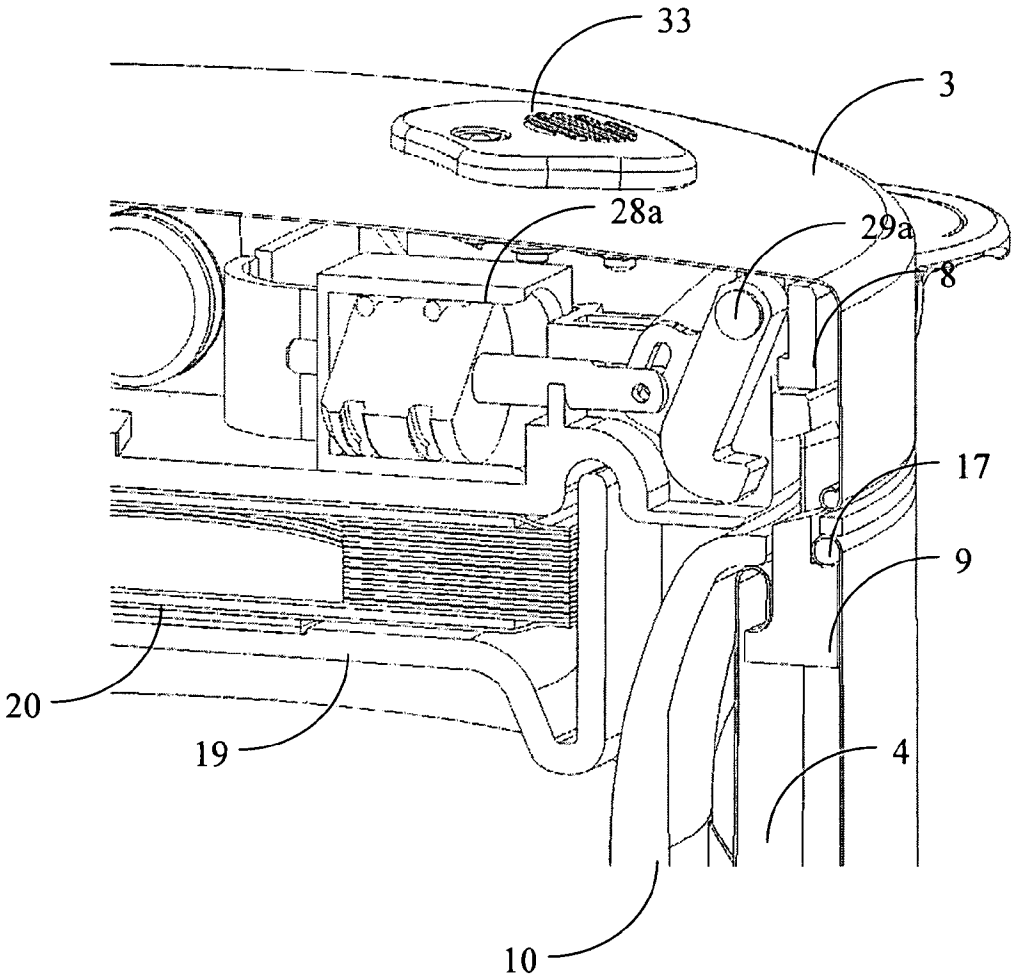
FIGS. 13*a* and 13*b* illustrate a locking hook detail.
Figure 13B:
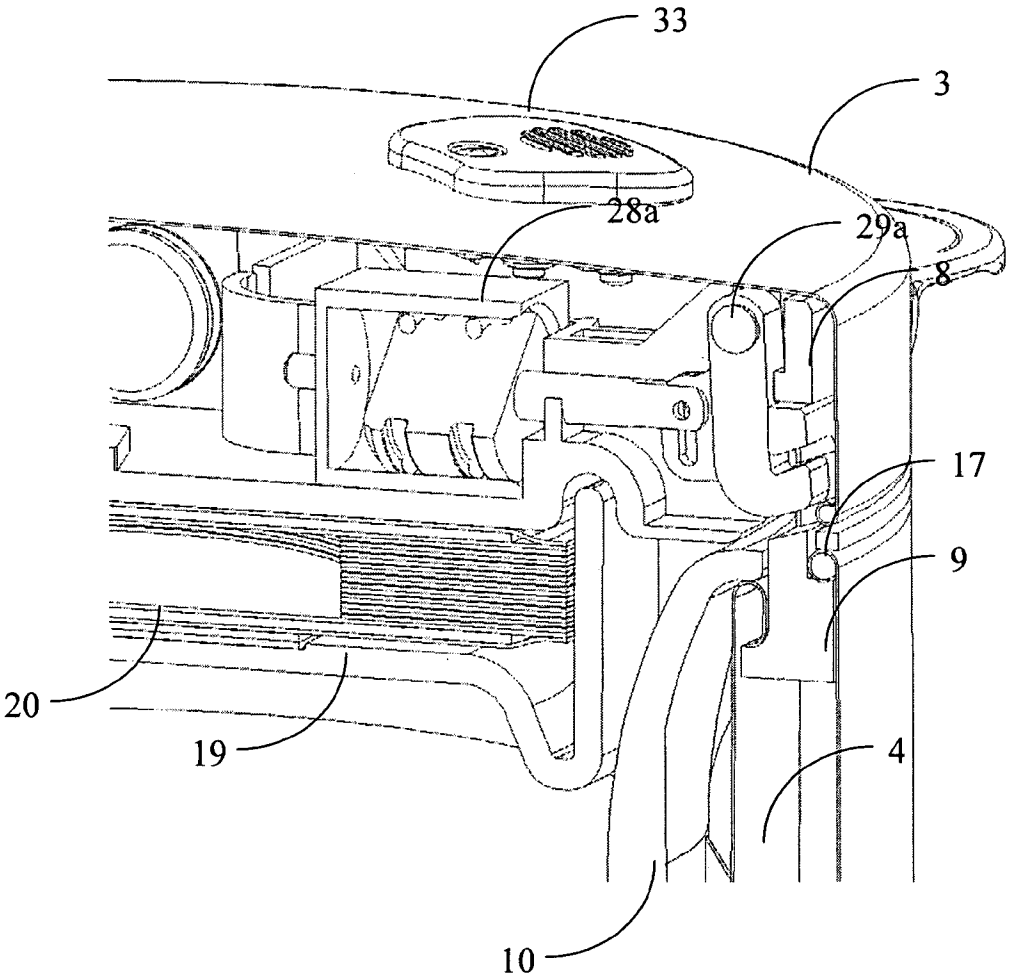

FIGS. 13*a* and 13*b* illustrate the hook 29*b* in a locked (FIG. 13*a*) and in an unlocked (FIG. 13*b*) position.

Figure 14:
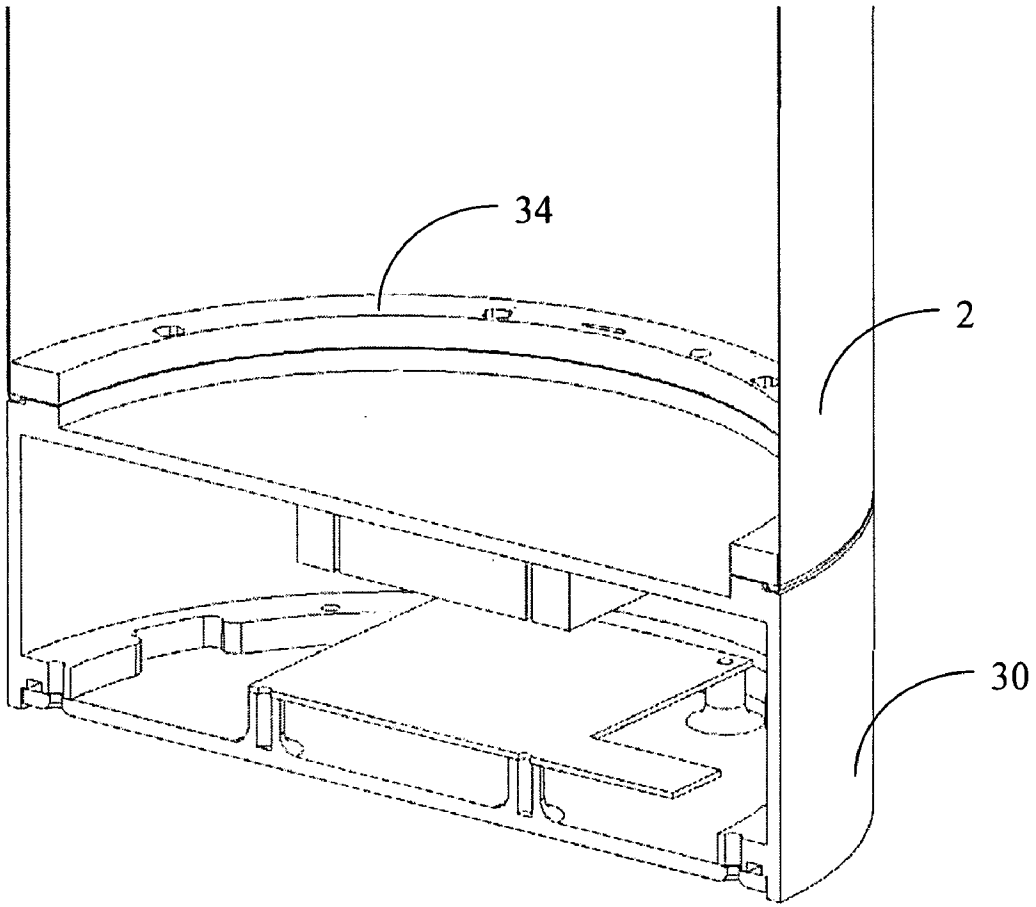
FIG. 14 is a perspective cross section of part of the bottom of a waste compaction unit.

Finally referring to FIG. 14 the pump assembly 5 will be described in more detail.

A housing 30 houses a pump (not shown) together with electronic circuitry to operate the pump when required. The pump is a rotary vane pump which has the benefit of being reversible.

The pump is electrically connected to a switch panel 33 on the lid by wires which extend through the bottom of the bin and between the outer bin 2 and the inner bin 4 through an aperture (not shown) near the top of the outer bin and near a hinge connecting the outer bin 2 to the lid 3. The wires then enter through an aperture in the lid 31 (FIG. 6*b*) and through the aperture 24 in the lid moulding and connect to a switch panel 33 (FIG. 13*a*/13*b*) mounted on the lid 3.

The pump is pneumatically connected to the bellows by a tube which extends through the bottom of the bin and between the outer bin 2 and the inner bin 4 through an aperture (not shown) near the top of the outer bin and near a hinge connecting the outer bin 2 to the lid 3. The tube then enters through an aperture in the lid 32 (FIG. 6*b*), through the aperture 25 in the lid moulding and connects to the bellows via the pneumatically driven locking mechanism.

The housing 30 is connected to the bottom of the bin outer by bolts which are inserted through the original base and into a locking ring 34.

The pump has two modes of operation. A short compression cycle, which briefly compresses any waste in the unit, in order to introduce more waste for example, and an extended compression cycle, during which the waste is compressed for a fixed amount of time (for example overnight) or until a specified pressure is reached.

During the extended compression cycle a compressive force is applied to the waste continually for a period of several hours during which time all plastic material lose their shape memory and remain in a compressed or flattened state with no tendency to return to their original formed shape.

The pump operates at three to four psi (20.7-27.6 Pa). This exerts a force of between 150-200 lbs (667-890 Newtons).

On activation of the pump, the pneumatically operated hooks are caused to lock the bin lid shut. Once the lid is locked, the bellows inflate, thus extending the plunger and compacting any waste in the unit for either a fixed period of time or until a predetermined pressure is reached.

Figure 15:
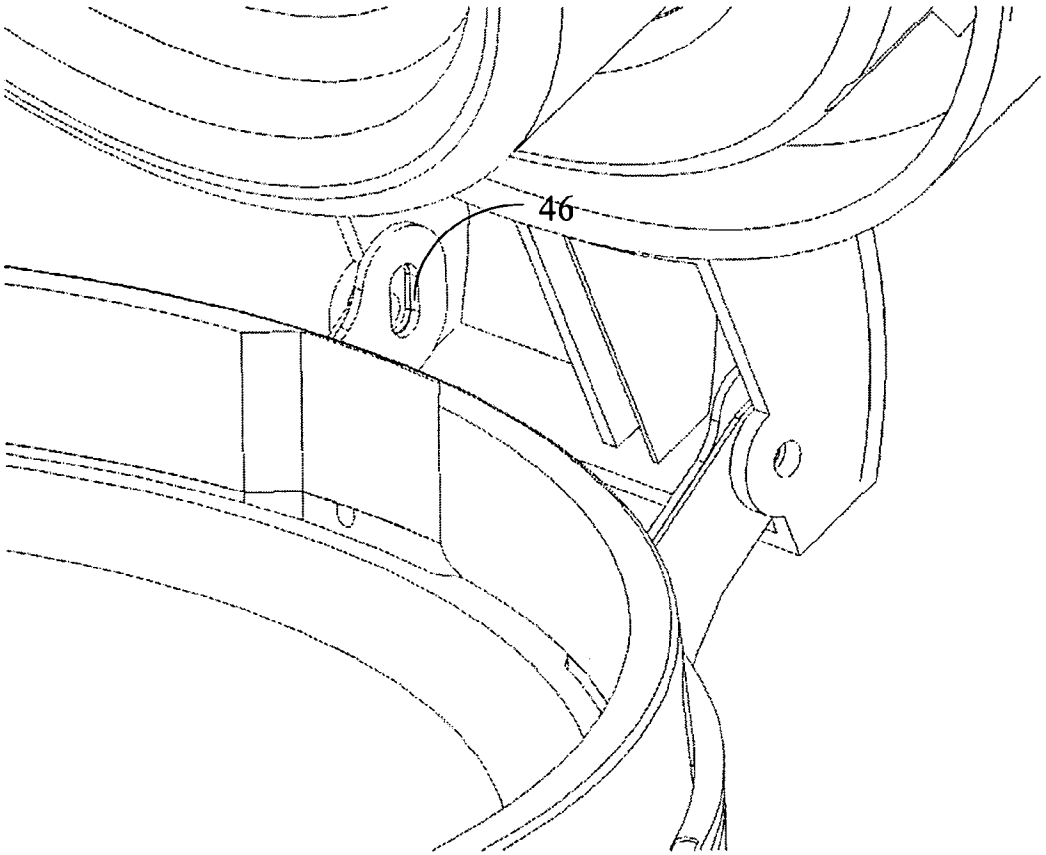
FIG. 15 is a close up view of a hinge detail.

As the pressure inside the bellows increases pressure is exerted on the lid. FIG. 15 illustrates a modified hinge 46 which has been elongated to allow vertical lid travel when the bin is pressurised. The lid lifts slightly thus locking each hook into each corresponding aperture.

A pressure switch may be used to switch off the pump once the predetermined pressure has been achieved. In practice, this means that the bellows inflate to a certain pressure and the pump turn off. After the waste has been compressed for a while the pressure drops as the waste becomes compressed and the pump switches on once more.

Figure 16D:
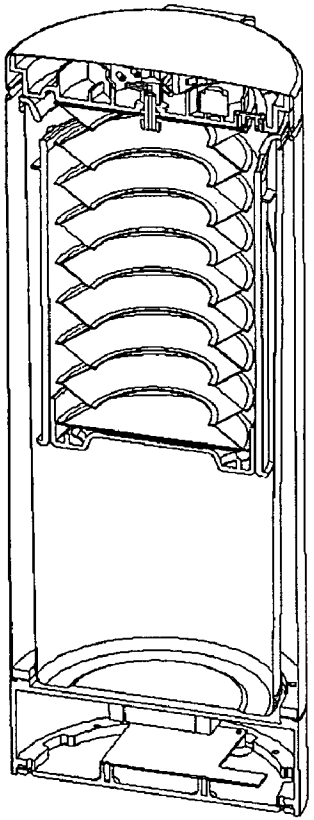
FIGS. 16*a* to 16*d* illustrates bellows in partially and fully extended configurations.
Figure 16C:
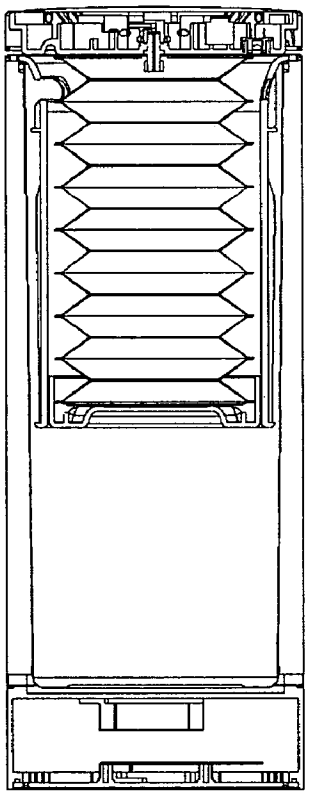
Figure 16B:
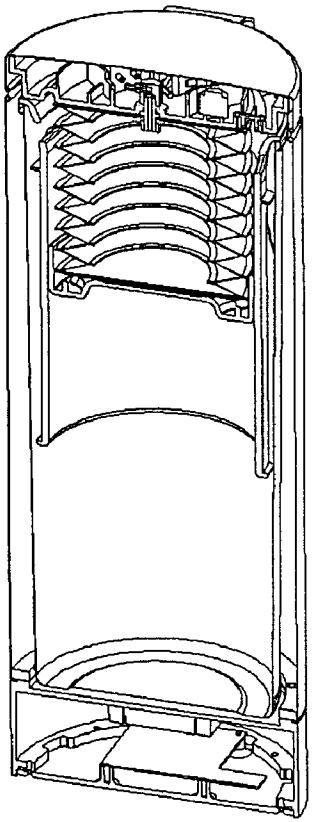
Figure 16A:
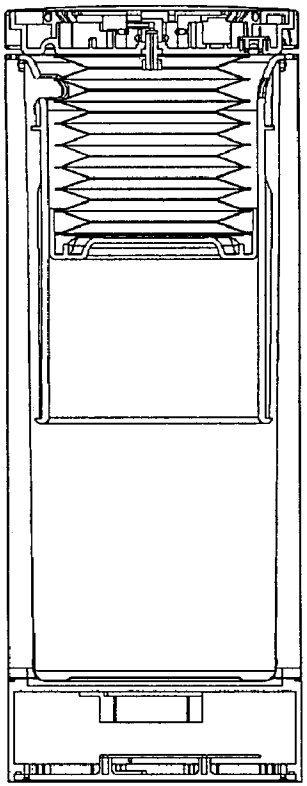

FIG. 16*a* and FIG. 16*b* are a cross section and a perspective cross section respectively showing the bellows 20 in a partially extended configuration. FIG. 16*b* and FIG. 16*c* are a cross section and a perspective cross section respectively showing the bellows 20 in a fully extended configuration.

As mentioned previously the pump will not operate if the plunger casing is not sensed by the sensor 23.

After the compaction cycle is complete the pump operates in reverse, the bellows deflates and the plunger retracts into the lid. Once the plunger has retracted fully, the pneumatically operated hooks release the bin lid in order that it may be opened once more.

An advantage of the waste compactor is that it is easily scaleable. It can be housed in a conventional domestic waste bin, or it can housed in any hollow, sealable container. It can be made larger for commercial use, such as for disposal of packaging in a fast food outlet where large amounts of compressible waste is produced. It can also be made smaller if desired. The waste compactor uses very little power typically around 22 Watts.

It will be understood by those skilled in the art that a number of modification may be made to the embodiment described above without departing from the scope of the invention as defined in the appended claims.

The invention claimed is:

1. A waste compaction unit for fitting into a housing comprising a lid and an interior for collecting waste, the compaction unit comprising a plunger comprising bellows housed in said lid;

a pneumatic locking mechanism housed in said lid, wherein the pneumatic locking mechanism comprises a plurality of pneumatically operated pistons which extend to lock the lid, and in which at least one of said pistons is connected to the bellows such that said piston prevents the bellows from inflating until said piston has extended to lock the lid; and a pump pneumatically connected to the plunger via a pneumatic connection to said locking mechanism wherein the pump is arranged in operation to pneumatically activate the locking mechanism to lock the lid prior to inflating the bellows to extend the plunger axially towards the interior of the housing such that any waste collected therein is compacted.

2. The waste compaction unit according to claim 1 wherein each of said pistons is connected to a hook which extends through an aperture in the lid when the corresponding piston is extended.

* * * * *